US005158330A

United States Patent [19]

Weyerstall et al.

[11] Patent Number: 5,158,330

[45] Date of Patent: Oct. 27, 1992

[54] VEHICLE HOOD OR DOOR LOCK

[75] Inventors: Bernd Weyerstall, Wuppertal; Klaus-Peter Claar; Jan Schilling, both of Gaechingen; Franz Waschitschek, Sindelfingen, all of Fed. Rep. of Germany

[73] Assignees: Bomoro Bocklenberg & Motte GmbH & Co. KG, Wuppertal; Mercedes Benz AG, Stuttgart, both of Fed. Rep. of Germany

[21] Appl. No.: 604,156

[22] Filed: Oct. 29, 1990

[30] Foreign Application Priority Data

Oct. 27, 1989 [DE] Fed. Rep. of Germany ..... 3935804

[51] Int. Cl.[5] ..... E05B 47/00; E05B 65/19

[52] U.S. Cl. ..... 292/144; 292/DIG. 43; 292/341.16; 292/DIG. 14

[58] Field of Search ..... 292/144, 201, 341.16, 292/DIG. 4, DIG. 14, DIG. 43; 70/281

[56] References Cited

U.S. PATENT DOCUMENTS

| | | | |
|---|---|---|---|
| 2,896,990 | 7/1959 | Garvey et al. | 292/229 |
| 3,016,968 | 1/1962 | Lenz et al. | 292/DIG. 43 |
| 3,334,405 | 8/1967 | Cann et al. . | |
| 3,384,405 | 5/1968 | Schiele | 292/216 |
| 3,830,554 | 8/1974 | Moussaian et al. | 292/DIG. 4 |
| 4,045,064 | 8/1977 | Okada | 292/DIG. 14 |
| 4,312,197 | 1/1982 | Carrion et al. | 292/DIG. 14 |
| 4,746,153 | 5/1988 | Compeau et al. | 292/DIG. 43 |
| 4,971,370 | 11/1990 | Detweiler et al. | 292/DIG. 43 |

FOREIGN PATENT DOCUMENTS

| | | | |
|---|---|---|---|
| 1127746 | 4/1962 | Fed. Rep. of Germany . | |
| 3518010 | 11/1986 | Fed. Rep. of Germany | 292/DIG. 43 |

*Primary Examiner*—Renee S. Luebke
*Assistant Examiner*—D. Boucher
*Attorney, Agent, or Firm*—Sixbey, Friedman, Leedom & Ferguson

[57] ABSTRACT

A motor veicle compartment closure lock with a locking wedge (2) attached on the closure, and lock elements attached on an opening frame for the closure. The locking wedge (2) can be retracted, in a powered way, from an extended, open position into a pushed-in, locked position and, for this purpose, is coupled by a lever mechanism (3) to a power transmission element (5) with a powered drive. The powered drive can be built especially small and light because the drive is made as a drive that operates only in one direction (locking direction) and returns automatically in the opposite direction. Power transmission element (5) is slaved or can be slaved to the locking wedge (2) in the locking direction and moves freely in the opposite direction. A shifting lever (6) is provided that is carried by the power transmission element (5) in the locking direction and is spring-loaded in the opposite direction. The shifting lever has an engaging part (7) that moves in a shifting link (8), and the engaging part (7) can be brought by a movement in the locking direction, from an open rest stop (9), to lie against a locking stop (10) and can be brought, by renewed movement in the locking direction, from the locking stop (10) back again to the open rest stop (9).

18 Claims, 3 Drawing Sheets

VEHICLE HOOD OR DOOR LOCK

BACKGROUND OF THE INVENTION

The invention relates to a lock for a vehicle compartment closure, e g a lock for motor vehicle hood, door, hatch or tailgate.

The known motor vehicle hood lock (which is basically suitable also as a lock for a hatch or the like) on which the invention is based (U.S. Pat. No. 2,896,990) has a locking wedge or striker on the vehicle body, namely on the frame for a trunk lid. The locking wedge is placed in a housing and can be pushed in or extended with the help of a threaded spindle. This locking wedge is configured like a hoop, as generally the concept of the locking wedge, does not necessarily require a wedge shape. Quite generally, as a technical term, a locking wedge or striker designates the support for the latch or strike plate of a motor vehicle hood lock or door lock. Other designations are locking clamp, locking shackle, etc.

In the prior art the threaded spindle is driven by an electric motor, capable of being driven in two directions of rotation, by a reduction gear. When the latch engages on the locking wedge, the electric drive motor is turned on by an electric switch and the locking wedge is moved into the locked position at which time the electric motor is again turned off An electromagnetic, centrally controlled locking drive that releases the latch to open the motor vehicle hood lock is allocated to the latch. By the electric switch which is provided, the electric motor for the locking wedge is also started again to bring the locking wedge, now independent of the latch, again into the extended, open position.

The known motor vehicle hood lock or door lock explained above, on which the invention is based, is complicated to build, occupies a great deal of space, is heavy and, consequently, is highly unsuited for placement in a trunk lid. Thus, the arrangement in this prior art is such that the locking wedge that can be moved by an electric motor is located in the frame; the latch, Which is released electromagnetically, is located in the trunk lid.

Further, centrally controlled locking drives for releasing latches or the like in motor vehicle door locks that drive in one direction only and which are able to return automatically in an opposite direction, in particular pneumatic drives, are also known (e.g., U.S. Pat. No. 3,384,405). These devices occupy very little space and are rather light.

SUMMARY OF THE INVENTION

An object of the invention is to provide a motor vehicle compartment closure (e.g., hood or door) lock that is built in a functionally similar manner to the motor vehicle hood lock or door lock explained above but which occupies considerably less space and is considerably lighter.

The object outlined above is achieved in accordance with a preferred embodiment of the present invention by a locking structure for a compartment closure of a vehicle, comprising locking means attachable to one of the compartment closure or a compartment opening frame on the vehicle, the locking means on the one being arranged to cooperate with latching means on the other one of the compartment closure and opening frame to lock the closure in the opening frame.

The locking means includes a locking wedge and a locking wedge drive means. The locking wedge is movable along a guideway between an extended open position and a retracted locked position.

The locking wedge drive means is connectable with the locking Wedge through a power transmitting mechanism which is operative upon actuation thereof to move against a return force in a locking direction. The power transmitting mechanism is slavable to the locking wedge in the locking direction and freely movable in an opposite direction. Operatively connected to the power transmitting mechanism is a shifting lever means comprising engaging means for movement within a shifting link. The shifting lever means is movable via the power transmitting means. Thereby, the engaging means can be brought by a movement in the locking direction from an open rest stop corresponding to said extended open position of the locking Wedge to lie against a locking stop corresponding to the retracted locked position of the locking wedge, and can, by a renewed movement in the locking direction be brought from the locking stop back to the open rest stop.

The motor vehicle closure lock (designated as such below for convenience without limitation of the invention) according to the invention is suited particularly for attaching the locking wedge, which can be pushed in and extended, as explained above, to a closure, in particular in a trunk lid. Especially with the use of a pneumatic drive, the motor vehicle compartment closure lock according to the invention can be built small and light enough that it not only can easily fit in a trunk lid but does not especially burden the latter with respect to weight.

Further objects features and advantages of the invention will be apparent from the following explanation of a preferred embodiment taken in connection with the drawings.

DETAILED DESCRIPTION OF THE PREFERRED EMBODIMENT

Figure 1:
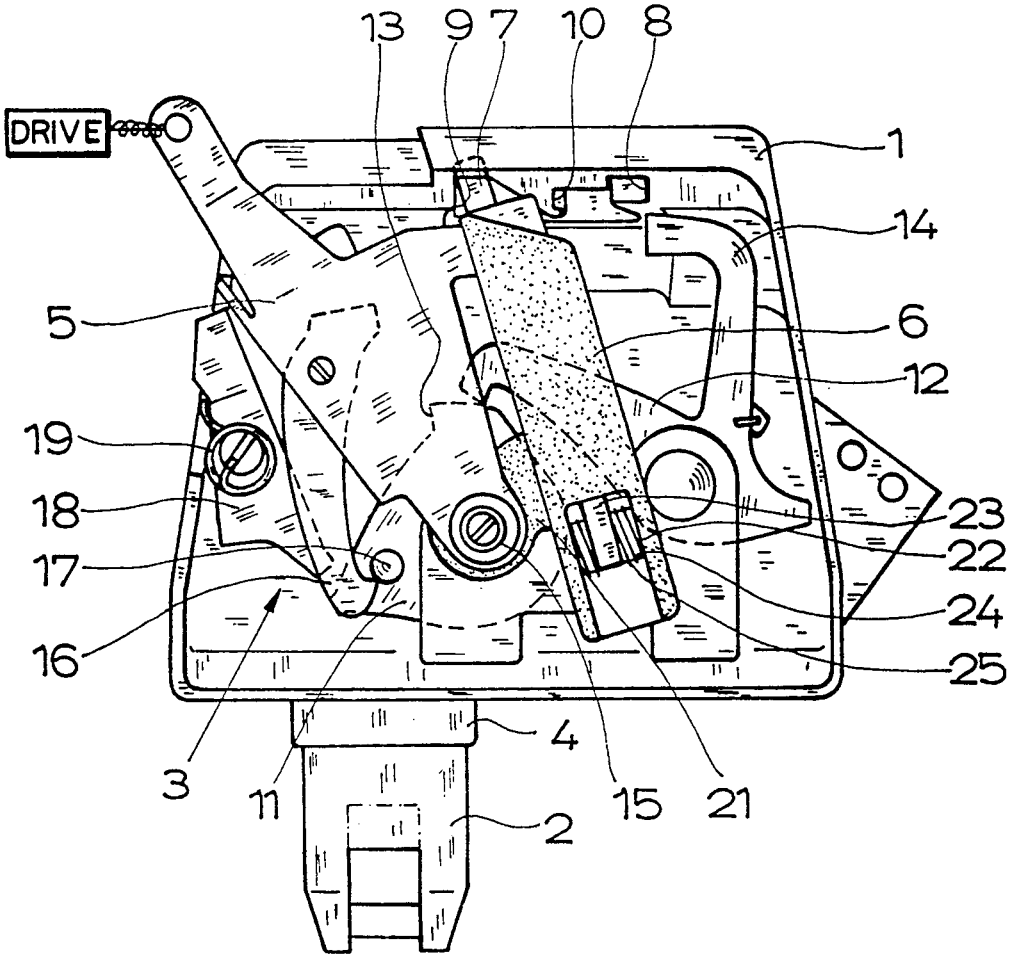
FIG. 1 is an elevational view of an open rear side of an embodiment of a motor vehicle lock according to the invention with a locking Wedge in the extended, open position.

The motor vehicle compartment closure lock represented in FIG. 1 is intended, in the embodiment represented, for attachment to a trunk lid of a motor vehicle. However, it could also be attached, for example, to a closure such as a hood, door, latch or tailgate or to another part of a motor vehicle. A striker or locking wedge 2 (for purposes of this disclosure, these terms are synonymous) is attached in a housing 1 to the trunk lid (not shown). Also belonging to such a motor vehicle compartment closure lock are lock elements, a latch and a locking pawl, attached to a compartment opening frame for the trunk lid. The latter structure is known and the present invention is not concerned With the details of this structure. Accordingly, a representation thereof is omitted. Basically, locking Wedge 2 could also be attached to the frame of the trunk opening In this case, the latch and locking pawl with the associated lock mechanism would be provided on the trunk lid. Particular advantages of the former arrangement of the design represented lie in space and weight considerations.

Figure 2:
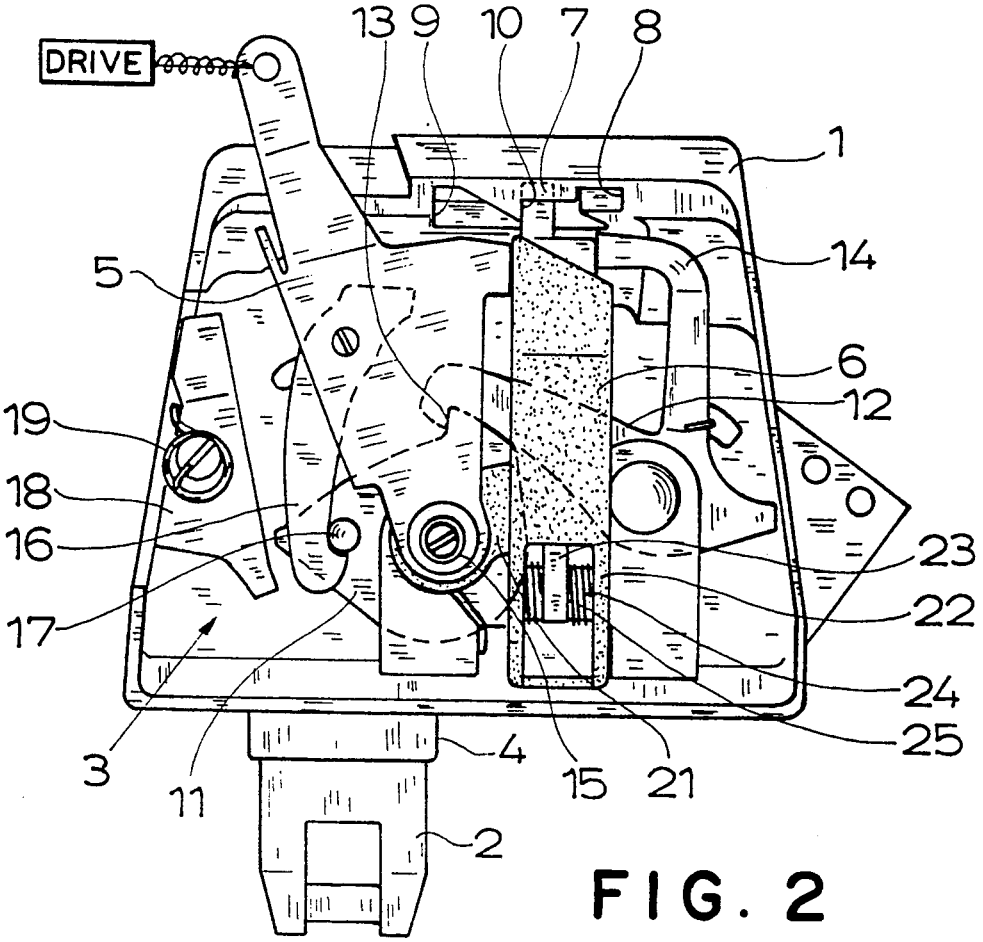
FIG. 2 is a view similar to FIG. 1 with the locking Wedge in the pushed-in, locked position.

Locking wedge 2 can be pushed in, in a driven manner, relative to housing 1 and thus relative to the hood from an extended, open position, represented in FIG. 1, into a pushed-in, locked position, represented in FIG. 2 (and in FIG. 1 by the broken line). For this purpose, locking wedge 2 is coupled by a lever mechanism 3 to a powered drive. Housing 1 has a guide 4 for locking wedge 2 and lever mechanism 3 includes a power transmission element 5 that operates between the drive and locking wedge 2. Power transmission element 5 is a rocking lever in the preferred embodiment, but it could also be a simple coupling rod, as described in further detail below.

The drive is designed so that it is power driven in one direction (locking direction) and automatically returns in the opposite direction In particular, as schematically depicted, this drive may be a pneumatic drive With return spring or the like. Power transmission element 5 is slaved or can be slaved in the locking direction to locking wedge 2 and moves freely in the opposite direction A spring-loaded shifting lever 6 is provided that is carried by power transmission element 5 in the locking direction and is spring-loaded in the opposite direction Shifting lever 6 goes with an engaging part 7 in a shifting link 8, and engaging part 7 can be brought by a movement in the locking direction, from an open rest stop 9, to lie against a locking stop 10 and can be brought, by another movement in the locking direction, from locking stop 10, again to lie against open rest stop 9. Thus, the design of lever mechanism 3 is particularly adapted for use with a drive that is actively operated only in one direction, namely in the locking direction Such a drive is, preferably, a pneumatic drive that offers the advantages explained above with respect to volume, design and Weight. Interaction of a shifting link 8 with a corresponding functional part of lever mechanism 3, namely engaging part 7 of shifting lever 6, causes one and the same movement of the drive to be translated into different subsequent movements of locking wedge 2.

With respect to the design details, there are naturally various possibilities of achieving the basic, above-explained teaching of the invention It has already been pointed out above that the illustrated design of power transmission element 5 as an independent rooking lever is not a necessity. Rather, a design could be realized in which the power transmission element is a simple connecting rod or the like that moves in a slotted link of the rocking lever, and even then the rocking lever itself (and, by it, also the power transmission element) would be coupled or would be able to be coupled to the locking wedge.

Various configuration possibilities will now be described in detail.

First, locking wedge 2 could be coupled or be able to be coupled directly to power transmission element 5 or to shifting lever 6, for this purpose locking wedge 2 could move in a curved guide 4, or power transmission element 5 or shifting lever 6 could perform a linear movement corresponding to the linear movement of locking wedge 2 but in the preferred embodiment represented in the figures, another solution is selected. Namely, a driver 11 is coupled to locking wedge 2 that is spring loaded in the opening direction and is coupled or can be coupled to power transmission element 5. With driver 11, an additional element of lever mechanism 3 is introduced that makes possible a translation of the primary linear movement of locking wedge 2 into a different type of movement, i.e., a pivoting movement in particular, of the remaining parts of lever mechanism 3.

Figure 5:
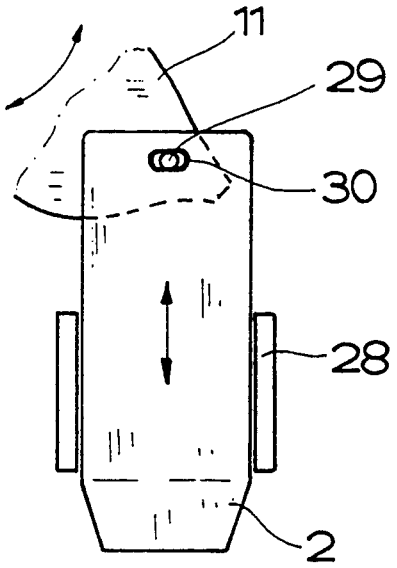
FIG. 5 is a schematic view from the front side With covering parts of the lock removed showing the coupling of the pivoting driver with the locking wedge.

FIG. 5 shows in detail the connection between pivoting driver 11 and reciprocating locking wedge 2. Indicated by guide means 28 is how the locking wedge 2 is guided to mo:;e linearly. This linear movement of the locking wedge 2 as guided by guide means 28 is translated into a pivoting movement of the driver 11 through a connecting pin 29 in a connecting slot 30 in wedge 2. Double-arrows show the directions of movement of the wedge 2 on the one hand and the driver 11 on the other hand.

Up to now nothing has been said as to how locking wedge 2 or driver 11 is kept in the locked position. This could basically be performed by engaging part 7 of shifting lever 6 in connection with shifting link 8 and its locking stop 10. But in the embodiment represented and thus preferred, a locking pawl 12, spring-loaded in the engaging direction, is allocated to driver 11. Locking pawl 12 engages, in the locked position, in a holding notch 13 formed on driver 11, and locking pawl 12 can be lifted by shifting lever 6 out of holding notch 13 upon renewed movement in the locking direction. In the preferred embodiment, locking pawl 12 engages in driver 11 or its holding notch 13. It could also engage directly on locking wedge 2 if a corresponding holding notch were provided there. Further, in the embodiment represented here, locking pawl 12 has a release arm 14 by which locking pawl 12 can be lifted out of holding notch 13 to release locking Wedge 2 to return to the open position under elastic force. In the preferred embodiment, release arm 14 is actuated by power transmission element 5 and with the intervention of shifting lever 6, a direct actuation would also be possible.

The embodiment represented and thus preferred of a lever mechanism 3 in a motor vehicle closure lock of the type being discussed is further distinguished in that the movements of power transmission element 5, shifting lever 6 and optionally driver 11 are arcuate movements. For this purpose, power transmission element 5, shifting lever 6 and, optionally, driver 11 are made as rocking levers that can be pivoted, preferably around one and the same pivot pin 15.

It has been mentioned above that locking wedge 2, or driver 11 for locking wedge 2, is coupled or can be coupled to power transmission element 5 or to shifting lever 6. The phrase "can be coupled" indicates the possibility that locking wedge 2 is not coupled. FIG. 1 shows this situation in the preferred embodiment when locking wedge 2 is in the open position. The release here of locking wedge 2 from power transmission element 5 protects against the possibility of an actuation of the drive when the hood is open, triggered for example by key actuation on the driver's door. Such actuation Would lead to movement of power transmission element 5 and of shifting lever 6 with engaging part 7 and here also of driver 11 into the locked position of FIG. 2. Without release, locking wedge 2 would be pulled in. Such actuation of the drive when the hood is open without the release of locking Wedge 2 could be disastrous if, next, the hood were slammed shut since the hood would automatically again spring open. With the release of the preferred embodiment, upon closing the hood following actuation of the drive, the locking wedge 2 can follow, under manual pressure, the previously traveled path of power transmission element 5 and correspondingly engages later.

The above-explained ability to be coupled is achieved in the preferred embodiment by a pawl connection 16 provided between power transmission element 5 and locking wedge 2 or driver 11, in that pawl connection 16 is not engaged in the open position of locking wedge 2 and optionally the power transmission element performs an idle stroke in the locking direction, and in that a prelocking position of locking wedge 2 is provided between the open position and the locked position wherein pawl connection 16 is engaged.

Besides the pawl in the embodiment represented, a pin 17 is located on driver 11 for engagement with pawl connection 16. It can be seen in FIG. 1 that, in the open position of locking wedge 2, during clockwise pivoting movement of power transmission element 5, the pawl of pawl connection 16 freely passes pin 17 while, when locking wedge 2, by manual closing of the hood, has been moved slightly in the locking direction to the prelocking position, the pawl of pawl connection 16 clearly grips pin 17 from behind, as can be seen in FIG. 2. If now the drive is turned on by a switch on the frame or at another point, then locking wedge 2 is carried by power transmission element 5, now solidly coupled to it. Of course, it is possible, in the configuration of the power transmission element explained above as a simple rocking lever, for example, to combine pawl connection 16 with shifting lever 6.

A comparison of FIGS. 1 and 2 makes clear another feature of the preferred embodiment of the inventive motor vehicle compartment closure lock It is normally to be prevented that locking wedge 2 can be brought purely manually out of the open position into the completely locked position. Rather, only the prelocking position of locking wedge 2 should be reachable purposely, and a further movement of locking wedge 2 should then be able to take place only by the drive To achieve this, before the drive is actuated, locking wedge 2, or driver 11, is stopped by a locking lever 18 from making any further movement beyond the prelocking position in the locking direction, and locking lever 18 is pivoted to free wedge 2 or drive 11 only when the drive is actuated. This can be seen especially well in FIG. 1. Locking lever 18 is spring loaded in the outwardly pivoted direction in a way known in the art by a spring 19 but, as illustrated in FIG. 1, is first held in the inwardly pivoted position by power transmission element 5 that is pivoted back by the drive. A brief advance assures that the starting drive first moves power transmission element 5 clockwise a little way so that, first, locking lever 18 is released and pivoted out of the path of movement of driver 11 under the power of spring 19. The further course of the pivoting movement then ends in the position represented in FIG. 2.

Figure 3:
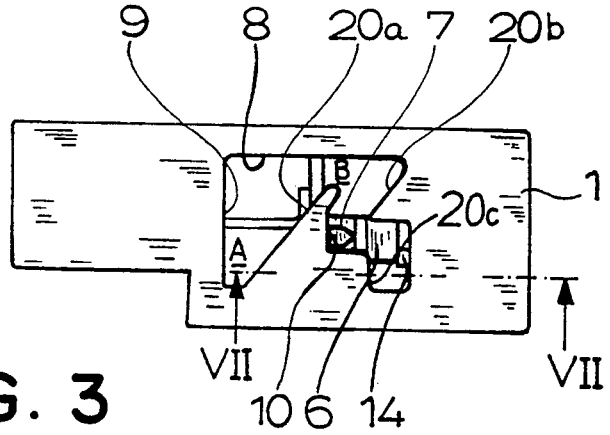
FIG. 3 is a plan view of a shifting link on the housing of the locking wedge.
Figure 4:
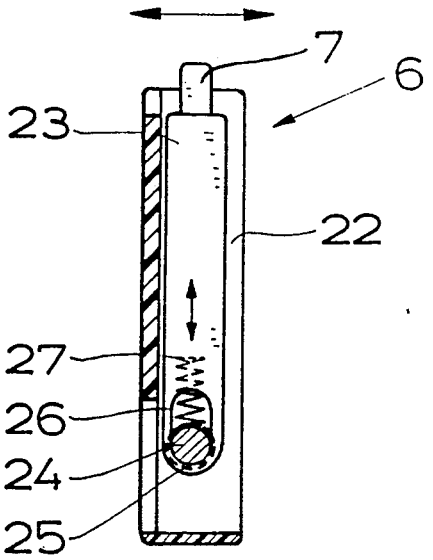
FIG. 4 is a lengthwise cross section through the shifting lever.

Shifting link 8 is now described in more detail. Shifting link 8 is generally functionally similar to mechanisms found in the disparate field of actuation mechanics for pressure ball point pens. The present invention provides an appropriate adaptation of such mechanisms to the conditions of motor vehicle hood locks This can be done in various ways and has been done in the preferred embodiment by extending shifting link 8 over several functional planes of lever mechanism 3 that are parallel to one another, and, preferably, by having a release arm 14 of locking pawl 12 lie in a functional plane with locking stop 10 as FIG. 3 shows especially clearly. The various functional planes of shifting link 8 make it possible simply to bring engaging part 7 of shifting lever 6 into engagement with certain elements of lever mechanism 3 during a movement in one functional plane but with other elements by a movement in the same direction in the other functional plane. If a release arm 14 for driver 11 or locking wedge 2 is provided on locking pawl 12, then the release arm is suitably placed in the functional plane of locking stop 10. During the movement of engaging part 7 from locking stop 10 back to opening rest stop 9, then release arm 14 of locking pawl 12 is actuated so that it is lifted out of holding notch 13.

In connection with the example of a shifting link 8, explained above, it is recommended that, to move engaging part 7 between the various functional planes, shifting link 8 comprise corresponding inclined guide surfaces 20 *a–c*. Furthermore, as apparent from FIGS. 1 & 2, the top of housing 1 slants upwardly from front to back, (i.e., from the foreground to the background of the figures). The role of these features in controlling the movement of shifting lever 6 will become apparent from the following further descriptions.

There are various possibilities for the configuration of shifting lever 6 (which, by the way can also assume functional tasks of power transmission element 5). First, as seen in FIG. 1 as Well as FIG. 2, shifting lever 6 is linked eccentrically to swivel pin 15. For this purpose, shifting lever 6 is provided With a linking arm 21 that is mounted to pivot on swivel pin 15. This has advantages from a movement engineering viewpoint, especially for engaging part 7 of shifting lever 6. Shifting lever 6 could be movable in and of itself relative to swivel pin 15; but, this would require a possibly complicated configuration of shifting link 8 considering arc movements occurring, and a possibly complex design at linking arm 21. Therefore, in the preferred embodiment, shifting lever 6 is made essentially in two parts. Namely, it consists of a stiff frame 22 carried by power transmission element 5 and an inner element 23, which includes engaging part 7, that is supported in frame 22 to move relative to frame 22.

Figure 6:
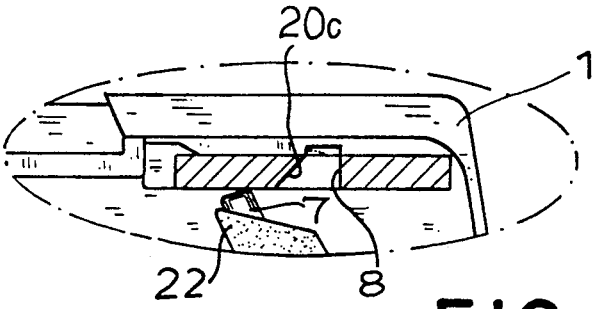
FIG. 6 is an enlarged view of a top part of the motor vehicle lock with the engaging part in a position just the shifting link.
Figure 7:
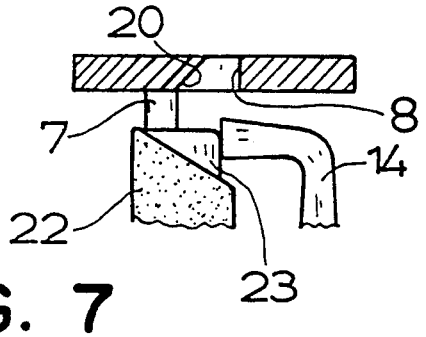
FIG. 7 is a view taken along line VII—VII in FIG. 3.

There are, of course, various possibilities for the two-part configuration of shifting lever 6 but, in the preferred embodiment, inner element 23 is supported on a pin 24 placed crosswise in frame 22 and can be pivoted around this pin 24 so that engaging part 7 can reach the various functional planes (guide surfaces 20*a–c*) of shifting link 8. Furthermore, inner element 23, preferably, can also be slid lengthwise relative to pin 24 by a slotted connection or the like, so that engaging part 7 can, optionally, slide on inclined guide surfaces 20*a–c* out of shifting link 8. In the preferred embodiment, a coil spring 25 is placed on pin 24 and presses inner element 23 into a predetermined setpoint position in frame 22, and the frame can be pivoted in the opposite direction toward engaging part 7 on inner element 23 by inclined guide surfaces 20*a–c* in shifting link 8 Further, here, the capacity of inner element 23 to be slid lengthwise relative to frame 22, again, against spring resistance, is realized. This has the advantage that, for the return movement of engaging part 7 from locking stop 10 to open rest stop 9, shifting link 8 does not have to contain any other channel by providing corresponding inclined guide surface 20*c*, with a ramp-like surface (FIG. 7) since the engaging part 7 can execute a downward lengthwise sliding movement of inner element 23 in FIG. 2, and thus, can pass through, so to speak, "under" shifting link 8 for this path, as shown in FIG. 6.

Thus, the sequence of movements in a cycle from rest stop 9 to blocking stop 10 and back is as follows. First, as shifting lever 6 moves clockwise from the FIG. 1 position (in which engaging part 7 is a position A in FIG. 3), guide surface 20*a* causes engaging part 7 to slide leftward and pivot rearward relative to pin 24, against the action of spring 25, until it clears surface 20*a* at location B. At this point spring 25 and lever 6 move engaging part 7 to the right in the figures until guide surface 20*b* is encountered. Then, the guide surface 20*b* (together with spring 25), during continued clockwise movement of shifting lever 6, cause a leftward and forward movement of engaging part 7 (part 7 being pivoted and slid relative to pin 24) until blocking stop 10 is encountered, at the position shown in FIGS. 3 & 7. To return to the open position, engagement part 7 is shifted further to the right as shifting lever 6 is moved clockwise (disengaging the locking pawl 12 via the above-noted displacement of release arm 14). Also, upon reaching the functional plane of guide surface 20*c*, engagement part 7 will be moved forwardly (downwardly in FIG. 3) under the action of spring 25 (Which will rotate it about pin 24 toward frame 22) and during this movement, the slanted top wall of housing 1 will press engagement part 7 downwardly against the force of spring 27. Now, return (counterclockwise) movement of shifting lever 6 will cause engaging part 7 to continue its downward movement against the action of spring 27 as the engaging part 7 slides upon guide surface 20*c* (FIGS. 3, 6 & 7), so that it can pass beneath shifting link 8. Once the engaging part clears the shifting link 8, spring 27 presses it upwardly and it engages stop 9, arresting further counterclockwise movement.

It can further be seen in the figures by suitable stipling that, in the embodiment represented, frame 22 of shifting lever 6 consists of a hard plastic, which is especially advantageous from a movement engineering viewpoint and with respect to noise generation.

Having thus described the invention in terms of a preferred embodiment thereof, it is to be understood that various modifications and embodiments within the scope and spirit of the invention will occur to those of ordinary skill in the art upon reading this disclosure. Accordingly, the invention is limited solely by the scope of the appended claims.

What is claimed is:

1. A locking structure for a compartment closure on a vehicle, comprising locking means attachable to one of a compartment closure and a compartment opening frame on the vehicle for cooperating with latching means on the other one of said compartment closure and compartment opening frame to lock said compartment closure int he compartment opening frame; wherein said locking means comprises a locking wedge and a locking wedge drive means, said locking wedge is movable along a guideway between an extended open position and a retracted locked position, said locking wedge drive means is connected with said locking wedge through a power transmission mechanism and is operative to move against a return force in a locking direction, and said power transmission mechanism is slaved to said locking wedge for movement int eh locking direction but is freely movable in an opposite return direction, and has shifting leer means operatively connected thereto, said shifting lever means comprising engaging means for powered movement within a shifting link in a locking direction via said power transmission mechanism, whereby said engaging means can be brought by a powered movement in the locking direction from an open rest stop, at a position corresponding to said extending open position of the locking wedge, to lie against a locking stop, at a position corresponding to the retracted locked position of the locking wedge, and can, by a renewed powered movement in the locking direction followed by a movement in the return direction, be brought from the locking stop back to the open rest stop.

2. A locking structure for a compartment closure on a vehicle according to claim 1, wherein the power transmission mechanism is a rocking lever.

3. A locking structure for a compartment closure on a vehicle according to claim 1, wherein the locking wedge is connection with a driver that is spring-loaded in the opening direction and the driver is connectable to the power transmission mechanism.

4. A locking structure for a compartment closure on a vehicle according to claim 3, wherein a locking pawl is spring-loaded into engagement with the driver, the locking pawl being able to fall into a holding notch placed on the driver in a locking position, and the locking pawl being liftable by the shifting lever means, out of the holding notch, upon said renewed movement in the locking direction.

5. A locking structure for a compartment closure on a vehicle according to claim 1, wherein the movements of the power transmission mechanism, and shifting lever means are arcuate movements and, for this purpose, the power transmission mechanism and shifting lever means are made as rocking levers that are pivotably mounted for movement around a single pivot pin.

6. A locking structure for a compartment closure on a vehicle comprising locking means attachable to one of a compartment closure and a compartment opening frame on the vehicle for cooperating with latching means on the other one of said compartment closure and compartment opening frame to lock said compartment closure int he compartment opening frame; wherein said locking means comprises a locking wedge and a locking wedge drive means, said locking wedge is movable along a guideway between an extended open position and a retracted locked position, said locking wedge drive means is connected with said locking wedge through a power transmission mechanism and is operative to move against a return force in a locking direction, and said power transmission mechanism is slaved to said locking wedge for movement in the locking direction, is freely movable in an opposite return direction, and has shifting lever means operatively connected thereto, said shifting lever means comprising engaging means for movement within a shifting link, said shifting lever means being ovable via said power transmission mechanism, whereby said engaging means can be brought by a movement in the locking direction from an open rest stop, at a position corresponding to said extended open position of the locking wedge, to lie against a locking stop, at a position corresponding to the retracted locked position of the locking wedge, and can, by a renewed movement in the locking direction, be brought from the locking stop back to the open rest stop; wherein an engageable and disengageable pawl connection is provided between the power transmission mechanism and the locking wedge by which, in the extended open position of the locking wedge, the pawl connection is disengaged and the power transmission mechanism can make an idle stroke in the locking direction, and wherein, between the extended open position and the retracted locked position, a prelocking position of the locking wedge is provided, the pawl connection being engaged in said prelocking position.

7. A locking structure for a compartment closure on a vehicle according to claim 3, wherein an engageable and disengageable pawl connection is provided between the power transmission mechanism and the driver by which, in the extended open position of the locking wedge, the pawl connection is disengaged and the power transmission mechanism can make an idle stroke in the locking direction, and wherein, between the extended open position and the retracted locked position, a prelocking position of the locking wedge is provided, the pawl connection being engaged in said prelocking position.

8. A locking structure for a compartment closure on a vehicle according to claim 7, wherein, When the locking wedge is stopped in one of the open position and prelocking position and the locking wedge drive means is not actuated, the locking Wedge is stopped from making a further movement in the locking direction by a locking lever the locking lever being freed to pivot only when the locking wedge drive means is actuated.

9. A locking structure for a compartment closure on a vehicle according to claim 6, wherein when the locking wedge is stopped in one of the open position and prelocking position and the locking wedge drive means is not yet actuated, the locking wedge is stopped from making a further movement in the locking direction by a locking lever, and the locking lever being freed to pivot only when the locking wedge drive means is actuated.

10. A locking structure for a compartment closure on a vehicle according to claim 1, wherein when the driver is stopped in one of the open position and the prelocking position and the locking wedge drive means is not actuated, the driver is stopped from making a further movement in the locking direction by a locking lever, and the locking lever being freed to pivot only when the locking wedge drive means is actuated.

11. A locking structure for a compartment closure of a vehicle according to claim 1, wherein the shifting lever means has several parallel functional planes and the shifting link extends over said several functional planes of the shifting lever means.

12. A locking structure for a compartment closure on a vehicle according to claim 11, wherein the shifting link comprises inclined guide surfaces for moving the engaging means among the functional planes.

13. A locking structure for a compartment closure on a vehicle according to claim 4, wherein the shifting lever means is configured to form several parallel functional planes; wherein the shifting link is movable over said several functional planes; and wherein a release arm of the locking pawl lies in one of said planes, said release arm having a locking stop contactable with said shifting lever means.

14. A locking structure for a compartment closure on a vehicle according to claim 13, wherein the shifting link comprises inclined guide surfaces for moving the engaging means among the several functional planes.

15. A locking structure for a compartment closure on a vehicle according to claim 11, wherein shifting lever means comprises a stiff frame carried by the power transmission mechanism and an inner element having an engaging part for contacting the shifting link, said inner element being mounted in said frame to move relative to said frame.

16. A locking structure for a compartment closure on a vehicle according to claim 15, wherein the inner element is mounted on a pin placed crosswise in said frame and can pivot around such pin so that said engaging part can reach said parallel functional planes of the shifting link.

17. A locking structure for a compartment closure on a vehicle according to claim 15, wherein the inner element can be slid lengthwise relative to the frame against spring resistance so that said engaging part can execute a downward lengthwise sliding movement out of contact With the shifting link.

18. A locking structure for a compartment closure on a vehicle according to claim 1, wherein said locking Wedge drive means comprises a pneumatic drive with a return spring.

* * * * *